United States Patent [19]

Iwao

[11] 4,352,551

[45] Oct. 5, 1982

[54] ELECTROPHOTOGRAPHIC FIXING DEVICE

[75] Inventor: Soichi Iwao, Okazaki, Japan

[73] Assignee: Minolta Camera Kabushiki Kaisha, Osaka, Japan

[21] Appl. No.: 269,858

[22] Filed: Jun. 3, 1981

[30] Foreign Application Priority Data

Jun. 6, 1980 [JP] Japan ..... 55-76781

[51] Int. Cl.[3] ..... G03G 15/00; B05C 11/00

[52] U.S. Cl. ..... 355/3 FU; 355/14 FU; 118/60; 118/101

[58] Field of Search ..... 355/3 FU, 14 FU, 15; 118/651, 652, 60, 101, 260; 430/350; 15/256.51, 256.52; 219/216; 432/60, 228

[56] References Cited

U.S. PATENT DOCUMENTS

| | | | |
|---|---|---|---|
| 3,268,351 | 8/1966 | Van Dorn | 355/3 FU X |
| 3,941,558 | 3/1976 | Takiguchi | 355/15 X |
| 4,277,161 | 7/1981 | Calabrese | 355/3 FU |
| 4,285,295 | 8/1981 | Iwao et al. | 118/60 |
| 4,290,691 | 9/1981 | Giorgini | 355/3 FU |

*Primary Examiner*—A. C. Prescott

*Attorney, Agent, or Firm*—Watson, Cole, Grindle & Watson

[57] ABSTRACT

An electrophotographic fixing device having a heat roller covered with a layer of silicone rubber, and an oil applying assembly for coating the surface of the heat roller with an offset preventing agent, such assembly comprising a felt impregnated with the offset preventing agent, and a metallic roller in surface rubbing contact with the felt to prevent offset of a toner image formed on a sheet passing over the heat roller surface, the present fixing device having a surface of its metallic roller roughened and in contact with a doctor blade of a material having a lower hardness than the material of the metallic roller. The doctor blade is in pressing contact with the roughened surface at a location to the rear of the position of rubbing contact between the felt and the metallic roller relative to the direction of rotation of the metallic roller.

4 Claims, 2 Drawing Figures

ELECTROPHOTOGRAPHIC FIXING DEVICE

BACKGROUND OF THE INVENTION

1. Field of the Invention

The present invention relates to a toner image fixing device for electrophotographic copying machines, etc., and more particularly to a fixing device by which toner images formed on a sheet are fixed thereto by heating with a heat roller;

2. Description of the Prior Art

As a toner image fixing method for such electrophotographic copying machines, etc., it is known to heat the toner on a sheet with the application of pressure by feeding the sheet to the nip of a heat roller having an internal or external heat source and a press roller in pressing contact with the heat roller. This method has the advantage that the toner can be fixed quickly since the toner is heated directly under pressure, but has objectionable problems, such as offset of toner image and winding of the sheet around the heat roller. For example, if the surface temperature of the heat roller is lower than an appropriate level, the toner image will not be fixed to the sheet effectively but adheres to the surface of the heat roller and is transferred (offset) at the lower temperature to another sheet subsequently fed to the roller. Conversely, if the surface temperature of the heat roller is higher than is appropriate, the toner becomes tacky, and when fixing to the sheet, the toner partly adheres also the heat roller to become transferred (offset) on the next sheet at the higher temperature. Furthermore, the tacky toner frequently causes the sheet to wind around the heat roller. To overcome these problems, heat rollers for the fixing devices of electrophotographic copying machines in recent years are covered with silicone rubber or like non-tacky material over the surface and are used as coated with an offset preventing agent such as silicone oil.

FIG. 1 schematically illustrates an example of a known generally described above fixing device. A heat roller 10 has an internal heat source generally designated H, and a press roller 11 is arranged in pressing contact with heat roller 10 which may be driven by some suitable means (not shown).. These rollers 10 and 11 are covered by a silicone layer 12 over their surfaces and are journalled parallel to one another in a suitable frame 20. A metallic roller 13 typically has a polished surface and is in rubbing contact with a felt element 14 impregnated with silicone oil. A metallic doctor Blade B bears against the surface of roller 13 for controlling the desired thickness of silicone oil applied to roller 13. A rubber roller 15 has its surface in light contact with the surface of metallic roller 13 and heat roller 10, and functions to transmit the rotation of heat roller 10 to metallic roller 13. The silicone oil applied to the surface of rubber roller 15 by the rotation of roller 13 is also applied to the surface of heat roller 10 by rubber roller 15. With such a fixing device, silicone oil is applied to the surface of heat roller 10 almost simultaneously with the start of rotation thereof for preventing offset when a sheet passes between rollers 10 and 11.

However, it has been noted that the aforedescribed arrangement involves difficulties in fully uniformly coating the heat roller surface with silicone oil for the following reasons.

When a large excess of silicone oil is not applied to metallic roller 13 by felt element 14, the surface of roller

13 becomes locally uncoated with silicone oil which produces problems.

Even if an excess of silicone oil applied to the polished surface of the metallic roller 13 is regulated by doctor blade B, any misalignment between the doctor blade and the roller, or any deflection of roller 13 or like causes results in an improper contact between the wiper blade edge and the metallic roller, so that the blade fails to regulate the amount of silicone oil uniformly.

Molten toner particles may thus enter the clearance between blade B and roller 13 and are cooled. When this repeatedly occurs, the initial nuclei grow to enlarge the clearance, thereby leading to an uneven application of silicone oil.

If an increased pressure is applied to blade B to eliminate uneven application, the blade in turn defaces roller 13 which likewise results in an uneven application.

For the causes or reasons given above, the surface of heat roller 10 becomes locally uncoated or coated to excess with silicone oil. Such uneven coating occurs early after the device is placed into use, thereby causing partial offset, leaving oil stains on the sheet during copying and creating other problems. Furthermore, silicone rubber covering 12 of heat roller 10, thus unevenly coated with silicone oil, absorbs the oil and locally swells, with the resulting problems that wrinkles are formed in the sheet passing between rollers 10 and 11.

SUMMARY OF THE INVENTION

The foregoing drawbacks are substantially avoided by the present invention in that the heating roller of the present fixing device is capable of being uniformly coated with silicone oil so that toner images can be more appropriately free of offset and without the likelihood that the sheet will become wrinkled or wound around the heat roller.

The above general objective is attained in accordance with the present invention by providing a fixing device comprising a heat roller covered with a layer of silicone rubber, and oil applying means for coating the surface of the heat roller with an offset preventing agent, the oil applying means comprising a felt element impregnated with the offset preventing agent, and a metallic roller in surface rubbing contact with the felt element to thereby prevent the offset of a toner image formed on a sheet passing over the heat roller surface, the fixing device being characterized in that the surface of the metallic roller is roughened and is in contact with a doctor blade of a material having a lower hardness than the material of the metallic roller. The doctor blade is in pressing contact with the roughened surface at a location to the rear of the position of rubbing contact between the felt element and the metallic roller relative to the direction of rotation of the metallic roller.

Other objects, advantages and novel features of the invention will become more apparent from the following detailed description of the invention when taken in conjunction with the accompanying drawings.

DESCRIPTION OF THE PREFERRED EMBODIMENT

Figure 1:
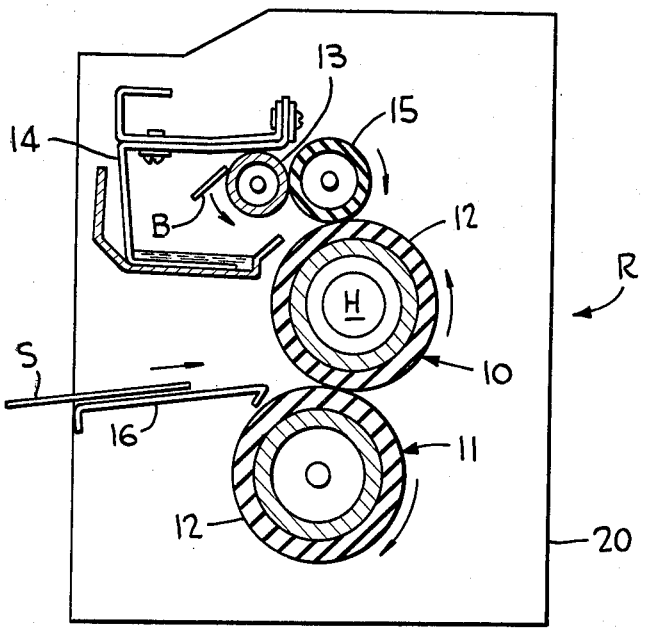
FIG. 1 (PRIOR ART)
FIG. 1 is a schematic side elevational view, partly in in section, of a conventional fixing device.
Figure 2:
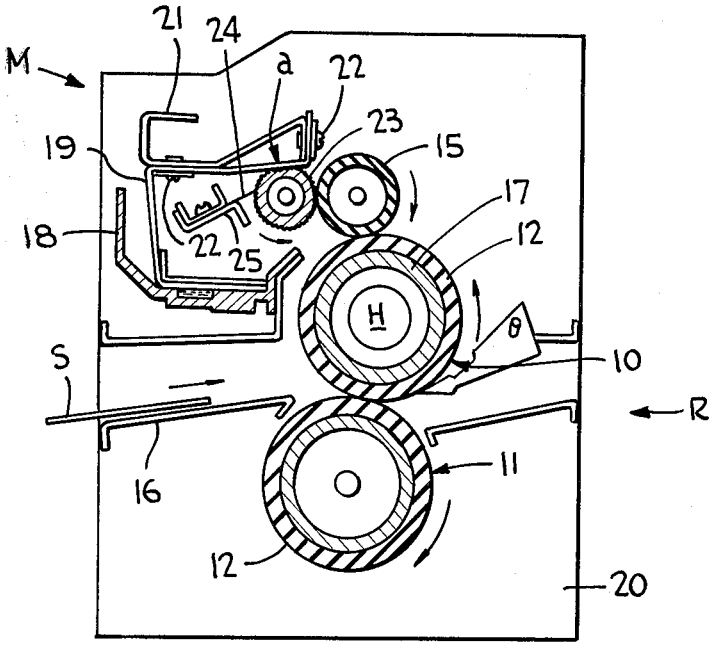
FIG. 2 is a similar view of a fixing device embodying the present invention.

The fixing device embodying the invention will be described hereinbelow with reference to FIG. 2, like parts in both views being designated by the same reference numerals.

A sheet S having a toner image formed on its upper surface in any conventional manner is moved by means (not shown) on a guide plate 16 in a forward direction indicated by the arrow. Heat roller 10 is disposed on the upper side of the path of advance of sheet 5 and is rotatably driven in the direction of the curved arrow, sheet S being fed between rollers 10 and 11 with its image bearing surface in contact with roller 10. The main body of heat roller 10 comprises a metallic core 17 having a good heat conductivity and being covered with a layer of silicone rubber 12 having no tackiness and being highly resistant to heat. When fixing toner images, heat roller 10 is heated to a specified temperature by heat source H of some general type incorporated therein. Press roller 11 is disposed below heat roller 10 in pressing contact therewith and is driven by the heat roller. The two rollers 10 and 11 constitute a fixing roller assembly generally designated R. When the toner image bearing sheet S passes between these rollers, the toner is heated and pressed at the same time and is thereby fixed to sheet S.

Oil applying means generally designated M is mounted on the frame above heat roller 10 and to one side thereof for coating the surface of the heat roller with silicone oil. Oil applying means M includes an oil container 18 containing silicone oil and is formed of a heat-resistant PBT resin. A felt element 19 of about 1.5 mm thickness which may be of wool is supported at one end and its intermediate portion by a metallic plate 21 and includes a portion a maintained in a stretched condition by screws 22. The other end of the felt is in contact with the bottom of oil container 18 for drawing up the silicone oil. A metallic roller 23 in contact with stretched portion a of felt element 19 is rotatable in the direction of its associated arrow and is driven by the heat roller via rubber roller 15. Metallic roller 23 is made of stainless steel, such as AISI No. 304 according to the American Iron and Steel Industries, and has its surface sandblasted or otherwise roughened to a roughness factor of 10S according to the Japanese Institute Standard (JIS), that is Maximum height 10 μm, Reference length 2.5 mm. A doctor blade 24, which may be formed of a 0.2 mm thick phosphor bronze plate, is supported by a holder 25 so that the forward end of the blade is in pressing contact with the surface of roller 23 at a location to the rear of the position of rubbing contact between felt element 19 and roller 23 relative to the direction of rotation of the roller. Since this roller 23 is of stainless steel (AISI No. 304) and blade 24 is a phosphor bronze plate as described above, the blade is lower than that of roller 23. Rubber roller 15 is rotatably mounted in the vicinity of roller 23 and is in contact at one side thereof with roller 23 and bears at its lower portion on heat roller 10 to transmit the rotation of the heat roller to roller 23 and to also coat the surface of the heat roller with the silicone oil applied to the surface of roller 23.

The aforedescribed fixing device operates in the following manner. When the source of power (not shown) for heat source H is turned on by suitably provided switch means (also not shown), metal core 17 of heat roller 10 is heated to heat silicone rubber covering 12 of the roller to a temperature suitable for fixing. The heat roller is rotated via another switch means (not shown), whereupon rubber roller 15 is driven by the rotation of the heat roller and transmits the rotation to roller 23. At the initial stage of rotation of roller 23, the forward end of blade 24 is abraded by the roughened roller surface and thereby properly comes into intimate contact with such surface. At the same time, silicone oil is applied to the surface of metallic roller 23 and is uniformly spread by the doctor blade. Since the surface of roller 23 is roughened, an excess of silicone oil applied thereto is removed, although a suitable amount of silicone oil remains to form a uniform coating over its entire surface without irregularities. Further, because blade 24 applies a constant braking force to roller 23 during rotation, roller 23 is maintained in slipping contact with rubber roller 15 at all times during rotation of rollers 23 and 15, whereby the consumption of silicone oil is suitably controlled.

The silicone oil which is uniformly spread over the surface of roller 23 is applied to the surface of rubber roller 15 and is further applied to silicone rubber covering 12 of the heat roller.

On the other hand, press roller 11 is also rotated by the rotation of the heat roller, and sheet S is fed in a forward direction by being nipped between rollers 10 and 11. At such time, the toner image on sheet S is subjected to heat and pressure by the heat roller and the press roller and is properly fixed to the sheet. With the surface of silicone rubber covering 12 of the heat roller being uniformly coated with silicone oil, the toner image will not be offset and/or the sheet is not likely to wind around the heat roller. Since silicone rubber covering 12 is uniformly swollen by silicone oil, the speed of the transport by the heat roller and the press roller is constant axially of the rollers. Accordingly, the sheet will remain substantially wrinkle free.

During experimentation conducted by continuously using the aforedescribed fixing device according to the invention for fixing toner images to 30,000 sheets of A4 size plain paper, the device was found to operate free of any irregularities in the silicone oil coating and without entailing problems, such as offset of toner images and/or winding or wrinkling of sheets.

Substantially the same results were also achieved during experimentation carried out similarly with the use of a metallic roller roughened to a surface roughness of approximately 20S according to JIS, that is Maximum height 20 μm, Reference length 2.5 mm.

On the other hand, during experimentation conducted in which toner images were fixed to 100 sheets of A4 plain paper by continuously operating the same aforedescribed device with the exception of using a metallic roller 13 of sulfur-containing free-cutting steel (AISI No. 1213) and polished to a surface roughness of a 6.3S roughness factor according to JIS, that is Maximum height 6.3 μm, Reference length 0.8 mm, silicone oil was found coating portions of several millimeters in width at a spacing of several millimeters on the metallic roller, as well as thick or thin silicone oil coating portions over a width of tens of millimeters on the heat roller.

While the aforedescribed embodiment is so adapted that the silicone oil applied to the roller 23 is evened out by rubber roller 13 and then applied uniformly to heat roller 10, rubber roller 15 can be eliminated and the silicone oil applied to roller 23 can be applied directly to the heat roller without departing from the invention.

And, roller 23, which is adapted to be rotated by the heat roller, may be independently driven in accordance with the invention. In such case, roller 23 should be rotated at a lower peripheral speed compared to that of the heat roller.

Obviously, many other modifications and variations of the present invention are made possible in the light of the above teachings. It is therefore to be understood that within the scope of the appended claims the invention may be practiced otherwise than as specifically described.

What is claimed is:

1. In an electrophotographic fixing device comprising:

a heat roller and a press roller journalled parallel to one another in a frame, said heat roller being covered by a layer of silicone rubber;

oil applying means on said frame for coating the surface of said heat roller with an offset preventing agent to prevent offset of a toner image formed in a sheet fed through said rollers;

said oil applying means comprising a felt element impregnated with the offset preventing agent, a metallic roller having its surface in rubbing contact with said felt element, and being rotatably driven by said heat roller, and a metallic doctor blade having a forward end thereof in pressing contact with said metallic roller;

the improvement wherein said metallic roller has a roughened surface;

said blade being of a material having a lower hardness than that of said metallic roller, whereby said forward end of said blade is abraded by said roughened surface at the initial stage of rotation of said metallic roller and thereby comes into intimate contact with said surface for forming a uniform coating of said agent over the entirety of said surface without irregularities;

and said forward end of said blade lying to the rear of the position of rubbing contact between said felt element and said metallic roller relative to the direction of rotation of said metallic roller.

2. The device according to claim 1, wherein said roughened surface of said metallic roller has a roughness factor of at least 10S where the factor 10S denotes a roughness substantially greater than 6.3S, for example, according to the Japanese Institute of Steel.

3. The device according to claim 1, wherein said metallic roller is of stainless steel and said blade comprises a phosphor bronze plate.

4. The device according to claim 1, wherein said oil applying means further comprises a rotatable rubber roller located between said metallic roller and said heat roller for transmitting said offset preventing agent from said metallic roller on to the surface of said heat roller.

* * * * *